US005252257A

United States Patent [19]

Hoffmann et al.

[11] Patent Number: 5,252,257

[45] Date of Patent: Oct. 12, 1993

[54] WATER-CONTAINING CONCENTRATE OF AT LEAST ONE ALKYL- OR ALKENYL-SUBSTITUTED AMMONIUM COMPOUND

[75] Inventors: Heinz Hoffmann, Bayreuth; Günther Hertel; Hubert Seitz, both of Burgkirchen, all of Fed. Rep. of Germany

[73] Assignee: Hoechst Aktiengesellschaft, Frankfurt, Fed. Rep. of Germany

[21] Appl. No.: 834,414

[22] Filed: Feb. 12, 1992

[30] Foreign Application Priority Data

Feb. 15, 1991 [DE] Fed. Rep. of Germany ..... 4104618

[51] Int. Cl.[5] ..... C11D 1/62

[52] U.S. Cl. ..... 252/547; 252/8.8

[58] Field of Search ..... 252/182.34, 547, 8.75, 252/8.8

[56] References Cited

U.S. PATENT DOCUMENTS

| | | | |
|---|---|---|---|
| 4,399,045 | 8/1983 | Burns | 252/8.75 |
| 4,654,152 | 3/1987 | Cukier et al. | 252/8.8 |
| 5,059,625 | 10/1991 | Scardera et al. | 252/106 |
| 5,080,830 | 1/1992 | Damaso | 252/547 |

FOREIGN PATENT DOCUMENTS

| | | | |
|---|---|---|---|
| 1186619 | 5/1985 | Canada | 252/8.75 |
| 315126 | 5/1989 | European Pat. Off. . | |
| 1165007 | 9/1969 | United Kingdom | 252/8.8 |

OTHER PUBLICATIONS

K. Shimizu et al., *Chem. Abs.* 110:195196p (1988) (JP 63/260991).

*Primary Examiner*—Anthony McFarlane

*Attorney, Agent, or Firm*—Connolly and Hutz

[57] ABSTRACT

The concentrate contains an ammonium compound which carries a longer-chain and a medium-chain substituent on the nitrogen atom, and both the other substituents are either hydrogen atoms, methyl, ethyl or β-hydroxyethyl. The medium-chain substituent should have half the carbon atoms of the longer-chain substituent or one or two carbon atoms less than half. Instead of an ammonium compound, a mixture of several ammonium compounds can also be present which on average corresponds to the formula described above. In addition to water, the concentrate can also contain 0 to 10% by weight, relative to the total amount of the ammonium compounds, of one or more compounds which are selected from amongst alkali metal salts, ammonium salts, aliphatic amines, alkyl or alkenyl esters or olefins having 6 to 20 carbon atoms. The concentrates have a low viscosity, which makes them easily pumpable, transportable and meterable. They can be diluted without noticeable increase in viscosity and contain virtually no combustible solvents.

11 Claims, No Drawings

WATER-CONTAINING CONCENTRATE OF AT LEAST ONE ALKYL- OR ALKENYL-SUBSTITUTED AMMONIUM COMPOUND

DESCRIPTION

The invention relates to a water-containing concentrate of one or more alkyl- or alkenyl-substituted ammonium compounds which correspond on average to a specific formula which contains one nitrogen atom with up to two hydrogen atoms or up to two short-chain alkyl substituents, and one medium-chain and one long-chain alkyl or alkenyl substituent.

Water-soluble ammonium compounds which have one or two medium- to longer-chain alkyl or alkenyl substituents on the nitrogen atom are frequently used, for example in the detergent and textile auxiliary industries, where they are as a rule employed as dilute aqueous solutions. In order on the one hand to save transport and packing costs, and on the other hand to make them easily transportable and meterable, it is desired to use the water-soluble ammonium compounds in liquid form, as solutions in water or water-miscible solvents which are as concentrated as possible. It is disadvantageous here that the solvents as a rule make the concentrated solutions highly flammable and combustible and also make the disposal of the dilute aqueous solutions produced during use thereof more difficult by increasing their chemical oxygen demand (COD). Concentrated solutions in water only as a rule either exhibit as such unfavorably high viscosities and/or become highly viscous on dilution with water, which prevents uniform distribution and use thereof without problems. There is therefore a need for water-containing concentrates of alkyl- or alkenyl-substituted ammonium compounds having longer-chain substituents which are of low viscosity and can be diluted with water without problems.

GB Patent 1,165,007 discloses a mixture of two ammonium compounds, of which one has two long-chain and two short-chain substituents, the other has one long-chain and three short-chain substituents or a long-chain substituent, an arylalkyl substituent and two short-chain alkyl substituents on the nitrogen atom. The two ammonium compounds should be used in a mixture ratio of 10:1 to 1:1. In addition to other improvements, these mixtures should not give mucilaginous and stringy solutions, which contain 3 to 6% by weight of active substance. On average, these mixtures do not correspond in any of the mixture ratios mentioned to the formula to which the mixtures according to the present invention should correspond. In addition, nothing is said about the dilution ratio of aqueous concentrates which contain mixtures according to GB 1,165,007 in the customary critical viscosity range from about 15 to 50% by weight of active substance.

A liquid, easily water-dilutable low-viscosity concentrate which, in addition to the water content, is composed of two ammonium salts substituted by organic radicals, is disclosed in CA Patent 1,186,619. One of these two ammonium salts contains a long-chain and two short-chain alkyl substituents, the other, as the solubilizing ammonium salt, contains two long-chain and one short-chain alkyl substituents, and both ammonium compounds each contain one benzyl substituent which can in turn be substituted in the aromatic ring. A formula to which the mixture of both ammonium compounds should in general correspond in order to exhibit the desired properties is not given, nor any nitrogen-containing components of the mixture which do not carry any benzyl substituents.

U.S. Pat. No. 4,654,152 describes pumpable concentrate mixtures which contain two nitrogen compounds prepared in situ and substituted by organic radicals, dissolved in an alcohol which has 1 to 3 carbon atoms. One of these nitrogen compounds is an imidazolinium salt, the other an ammonium salt which carries two long-chain and two short-chain alkyl substituents on the nitrogen atom. The solution in alcohol makes the mixtures more expensive and increases their combustibility considerably. The alcohol content of aqueous dilutions of these mixtures further increases their chemical oxygen demand (COD) and as a result makes the disposal of such dilutions after use thereof more difficult.

The object of the invention is to make available a water-containing concentrate of one or more alkyl- or alkenyl-substituted ammonium compounds which, in the temperature range from 15° to 40° C. which is important for easy handling, has a low viscosity over a wide concentration range and can be diluted with water without a substantial increase in viscosity, and which furthermore can be made highly liquid and easily dilutable at very high concentrations by the use of temperatures up to 80° C.

The object is achieved by means of a water-containing concentrate of at least one alkyl- or alkenyl-substituted ammonium compound which contains a) an ammonium compound which corresponds to the formula

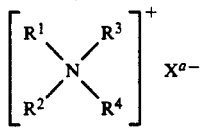

(I)

or a mixture of at least two ammonium compounds of which each corresponds to the formula

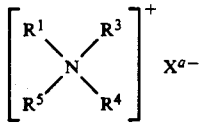

(II)

and the mixture on average corresponds to the formula (I), where in the formulae (I) and (II)

$R^1$ is a straight-chain or methyl-branched alkyl group or an alkenyl radical where n=8 to 20 carbon atoms, $R^2$ is a straight-chain or methyl-branched alkyl group or an alkenyl radical having n/2−p carbon atoms, in which p is 1 to 2 if the average of all n is 12.1 to 20, or p is 0 to 2 if the average of all n is 8 to 12, with the proviso that n/2−p is greater than 2, $R^3$ and $R^4$, which are identical or different, are a hydrogen atom, or a methyl, ethyl or β-hydroxyethyl radical, $R^5$ is a straight-chain or methyl-branched alkyl group or an alkenyl radical having 3 to 20 carbon atoms, which is smaller than or identical to $R^1$, X is an anion which is inert to the nitrogen-containing cation and has not more than 8 identical atoms and a is the valency of the anion X, with the proviso that 2 parts by weight of each ammonium compound of the formula (II) are soluble in 100 parts by weight of water at 50° C. without residue;

b) 10 to 85% by weight of water, relative to the total mixture; and c) 0 to 10% by weight, relative to the total amount of the compound(s) of the formula (I) or (II), of one or more compounds selected from alkali metal salts, ammonium salts, aliphatic amines, alkyl or alkenyl esters or olefins having 6 to 20 carbon atoms.

If the substituent $R^1$ and/or $R^5$ is an alkenyl radical, this can contain 1 to 3 double bonds in the carbon chain. The following are suitable as examples of the substituent $R^1$ or $R^5$: stearyl, palmityl, myristyl, lauryl, decyl, nonyl, octyl, methylstearyl, oleyl, linoleyl, linolenyl, eleostearyl and palmitoleyl. The following are moreover suitable as the radical $R^5$: allyl, 2-methylallyl, isoamyl, butyl, 2-methylhexyl, propyl and isopropyl. The substituent $R^5$ can be smaller than or identical to $R^1$.

If the mixture component a) is only an ammonium compound, the substituent $R^2$ in the formula (I) should have n/2−p carbon atoms, where n is the number of carbon atoms of the substituent R: and p in the case of a chain length of $R^1$ of 8 to 12 carbon atoms is the figures 0, 1 or 2, or in the case of a chain length of $R^1$ of 13 to 20 carbon atoms is only the figures 1 or 2.

If, for example, $R^1$ is stearyl ($C_{18}H_{37}$), the substituent $R^2$ can be either 18/2−1=8=octyl or methylheptyl or 18/2−2=7=heptyl or methylhexyl. On the other hand, if $R^1$ is, for example, decyl ($C_{10}H_{21}$), the following $R^2$ substituents are suitable: 10/2−0=5=pentyl or isoamyl; 10/2−1=4 =butyl or isobutyl; 10/2−2=3=allyl, propyl or isopropyl. If an integer is not calculated for the substituent $R^2$, for example for nonyl 9/2−1=3.5, in this case $R^2$ can have either 4 or 3 carbon atoms.

Often, mixtures of at least two ammonium compounds can advantageously be employed. If the mixture component a) is in turn a mixture of various ammonium compounds, each of these ammonium compounds of the formula (II) and the mixture of all these ammonium compounds should correspond on average to the formula (I). In this case, the particulars for n and p in formula (I) relate to a range of numbers within which the integer or fractional number for the mixture average should lie.

If it is wished to achieve a certain number average for p, the molar ratio in which the two ammonium compounds are to be mixed can be calculated from two different ammonium compounds of the formula II, called IIA and IIB below, whose number of carbon atoms in the substituents $R^1$ and $R^5$ are known, by the following equations:

$$x\,(IIA) = \frac{2p + 2(IIBR^5) - IIBR^1}{IIAR^1 + 2(IIBR^5) - IIBR^1 - 2(IIAR^5)}$$

$$y\,(IIB) = 1 - x$$

in these equations x (IIA) is the molar amount of the compound of the formula (IIA)

y (IIB) is the molar amount of the compound of the formula (IIB)

$IIAR^1$=number of carbon atoms in the substituent $R^1$ of the compound of the formula (IIA)

$IIAR^5$=number of carbon atoms in the substituent $R^5$ of the compound of the formula (IIA)

$IIBR^1$=number of carbon atoms in the substituent $R^1$ of the compound of the formula (IIB)

$IIBR^5$=number of carbon atoms in the substituent $R^5$ of the compound of the formula (IIB)

If it is intended, for example, to mix the compounds

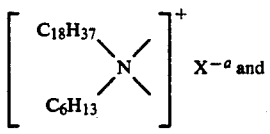

(IIA)

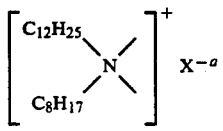

(IIB)

such that the mixture average is 1 below half of the average (=n) of the numbers of carbon atoms in both substituents $R^1$, i.e. p=1, and the average number of carbon atoms in the substituent $R^2$ in the formula (I) according to the invention=n/2−1, the following molar amounts of the compounds IIA and IIB are to be employed:

$$(IIAR^1 = 18;\ IIAR^5 = 6;\ IIBR^1 = 12;\ IIBR^5 = 8)$$

$$x = \frac{2 + 2 \times 8 - 12}{18 + 2 \times 8 - 12 - 12} = \frac{6}{10} = \text{0.6 mol of the compound IIA}$$

and $$y = 1 - 0.6 = 0.4 \text{ mol of the compound IIB.}$$

If negative molar amounts are obtained in this calculation, no mixture according to the invention with p=1 can be prepared from the compounds employed. If one of the two molar amounts is equal to zero, the other mixture component without admixture already satisfies the condition that the average number of carbon atoms in the compound of the formula (I) is equal to n/2−1.

As can be seen, the achievement of the effect according to the invention depends essentially on the average number of carbon atoms in the substituents $R^1$ and $R^2$ in the formula (I). The other substituents $R^3$ and $R^4$ and the anion X do not play an essential role in the context of the limits mentioned further above.

Preferably, only one ammonium compound of the formula (I) or a mixture of two different specific ammonium compounds of the formula (II), which both correspond to the formula

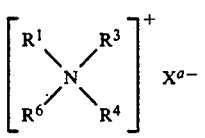

(III)

is employed in the mixture according to the invention. In formula (III)

$R^1$ is a straight-chain or methyl-branched alkyl group or an alkenyl radical where n=8 to 20 carbon atoms, $R^6$ is a straight-chain or methyl-branched alkyl group or an alkenyl radical having n/2±n/3 carbon atoms, with the proviso that n/2±n/3 is greater than 2, where $R^3$ and $R^4$, X and a have the meaning given further above.

If one or two preferred compounds of the formula (III) are used in mixtures of several ammonium compounds, IIIA is analogously to be employed instead of IIA and IIIA$R^6$ instead of IIA$R^5$ and, if appropriate, IIIB instead of IIB and IIIB$R^6$ instead of IIB$R^5$ in the computational formula given on page 6.

If $R^1$ and/or $R^6$ is an alkenyl radical, this can have 1 to 3 double bonds in the carbon chain. Examples of suitable substituents $R^1$ are mentioned further above.

The following are suitable, for example, for the substituent $R^6$: palmityl, myristyl, lauryl, decyl, nonyl, octyl, butyl, isoamyl, propyl, isopropyl, palmitoleyl, allyl and 2-methylallyl.

Because of their good utilizability and usually good accessibility, ammonium compounds of the formulae (I), (II) and (III) in which $R^1$ is a straight-chain or methyl-branched alkyl radical or alkenyl radical having 12 to 18 carbon atoms are preferably employed.

The substituents $R^3$ and $R^4$ in the formula (I), (II) or (III) can either both be, identical or different: a hydrogen atom, or a methyl, ethyl or β-hydroxyethyl radical. Good results are obtained if $R^3$ and $R^4$, which are identical or different, are a hydrogen atom or a methyl radical. Quaternary ammonium compounds of the formula (I), (II) or (III), in which $R^3$ and $R^4$ are each a methyl radical, are particularly preferred.

In the formula (I), (II) or (III), X is an anion which does not react with the corresponding nitrogen-containing cation and a is the valency of this anion. The anion should have no relatively long chains of atoms, as these affect the viscosity relationships of the concentrates according to the invention. It should have no more than 8 identical atoms. Preferably, straight or little-branched chains should have no more than 4 identical atoms. Good results are obtained with chloride, sulfate, phenylsulfonate or methylphenylsulfonate anions and in particular with bromide or methylsulfate anions.

The concentrates according to the invention contain 10 to 85% by weight of water, relative to the total mixture. The advantageous effect according to the invention occurs within such water contents. Mixtures having less than 10% by weight of water can be prepared with greater difficulty and greater outlay in terms of cost and sometimes do not have the desired low viscosity. Mixtures containing over 85% by weight of water result in unnecessarily high transport and packing costs and do not exhibit any more favorable properties compared to customary, usually quaternary, ammonium compounds of a comparable type. Advantageously, the mixtures according to the invention contain 15 to 60% by weight of water, relative to the total mixture (concentrate).

In addition to the compound(s) of the formula (I), (II) or (III), the concentrate according to the invention can additionally contain 0 to 10% by weight, relative to the total amount of the compound(s) of the formula (I) or (II) or (III) respectively, of one or more compounds which are selected from alkali metal salts, ammonium salts, aliphatic amines, alkyl or alkenyl esters or olefins which contain 6 to 20 carbon atoms. These compounds are as a rule obtained as by-products, for example by elimination reactions at temperatures from about 100° C., or as unreacted starting materials in the preparation of the concentrates according to the invention, and are not removed or are only partially removed in the working up of the reaction mixtures. Alkali metal salts can be, for example, the sodium or potassium salts of the anion X, as it occurs in the formula (I), (II) or (III), preferably the chlorides, bromides, sulfates, methylsulfates, phenylsulfonates or methylphenylsulfonates. The same applies to the ammonium salts, where the nitrogen-containing cation of these ammonium salts either does not correspond to one of the formulae (I) or (III) or at least does not contribute to it, in order to achieve, on average, the formula (I) in the mixture of all ammonium compounds in the concentrate.

The concentrates according to the invention can be prepared by mixing the individual components or advantageously by in situ preparation of the ammonium compound(s), if appropriate in the presence of water, and subsequent concentration by evaporation of solvents and, if necessary, by dilution with water, it being possible to add one or more separately prepared ammonium compound(s) in order to obtain or to optimize a mixture which on average corresponds to the formula (I).

The ammonium compound(s) are expediently produced, for example, from amines by processes known per se by addition of alkyl or alkylene esters, preferably of strong acids. Suitable esters are, for example, those of phosphoric acid, sulfuric acid, phenylsulfonic acid, methylphenylsulfonic acid, hydrochloric or hydrobromic acid. The alkyl and alkylene esters of carbonic acid are also highly suitable. It may be advantageous, after preparation of the corresponding ammonium salt substituted completely or partially on the nitrogen by a readily reacting acid ester, for example an alkyl bromide or a dialkyl carbonate, to replace the anion of the ammonium salt for another anion, for example chloride, if its ester, for example alkyl chloride, is not so reactive as the ester used for the reaction with the amine.

The reaction of the amine with the ester can be carried out without solvent, but it is usually advantageous to employ a solvent, in particular one which has with dipole moment, such as water, acetonitrile, alkanols, such as isopropanol, alkylene glycols, such as ethylene glycol or propylene glycol, or dialkylene glycols.

Solvent mixtures, for example water and an alkanol having 1 to 4 carbon atoms or water and acrylonitrile, can also be used with advantage. A part of the solvent or solvents used or, if the solvent is not water, even the entire amount of solvent can be removed and recovered, for example by evaporation. The same also applies to unreacted starting substances, such as amines and/or esters. The remaining ammonium compound or, if a mixture of amines or a mixture of esters or a mixture of amines and of esters was employed, the remaining ammonium compounds are then treated with water in an amount such that the mixture contains 10 to 85% by weight, preferably 15 to 60% by weight, of water, relative to the concentrate.

Instead of the ester, a mixture of the corresponding alkanol or alkenol together with an acid, an acid anhydride, acid chloride or acid bromide, for example an alkanol and methylphenylsulfonyl chloride, or an alkanol and hydrogen chloride, can also be used for the reaction with the amine.

The temperature for the reaction of the amine or the amines with the ester or the esters or their acid and alcohol precursors respectively can vary within wide limits. Temperatures of 20° to 150° C. are in general adequate. The reaction can be carried out at normal atmospheric pressure or the autogenous pressure of the reaction mixture. In general, pressures up to 1 MPa are adequate.

The primary, secondary or tertiary amines are prepared by known methods. If one or two substituents on the nitrogen atom of the ammonium compound are intended to be β-hydroxyethyl groups, secondary or primary amines can be reacted with ethylene oxide to prepare the ammonium compound, either before or after the reaction with ester described further above.

In the reaction, acids are expediently added which yield the anion for the ammonium compound(s) and are also catalytically active. Suitable acids are, for example, alkanoic acids, such as propionic acid, hydroxyalkanoic acids having a carboxyl group, such as lactic acid, or several carboxyl groups, such as citric acid, or inorganic acids, such as hydrochloric acid.

The concentrates according to the invention have a low viscosity, which makes them readily pumpable, transportable and meterable. They are also dilutable with water without noticeable increase in viscosity, which facilitates their use. The concentrates contain virtually no flammable solvents which can make the concentrates combustible and increase the chemical oxygen demand of the waste waters which are formed on use of the concentrates, which makes their disposal more difficult.

The following examples are intended to illustrate the invention.

1. Precursor for Examples 1 and 4

The following are added successively at room temperature with stirring to a flask of contents 1 $dm^3$ which is equipped with a stirrer, a reflux condenser and a contact thermometer and is surrounded at its bottom by an electrically heatable jacket which is controlled by the contact thermometer: 145.3 g (0.6 mol) of N-tetradecyl-N,N-dimethylamine, 249.3 g (6.07 mol) of acetonitrile and 104.0 g (0.63 mol) of 1-bromohexane. While stirring is continued, the mixture is heated to a temperature of 85° C. and kept at this temperature for 4 hours, then it is cooled to room temperature, a sample is taken and the residual amine content in this is determined. On the basis of this determination, the amine conversion is 99%. The contents of the flask are then added to a rotary evaporator and the liquid constituents, essentially acetonitrile, are distilled off in a water bath at a temperature rising from 50° to 80° C. and a pressure falling from 9.6 to 1.8 kPa at 320 revolutions per minute during the course of 4 hours. The N-tetradecyl-N-hexyl-N,N-dimethylammonium bromide (1) thus obtained is then dried at room temperature under a pressure of 40 Pa generated by an oil vacuum pump and used for the viscosity determinations described below. The product is analysed, the following values being determined:

| | |
|---|---|
| N-tetradecyl-N-hexyl-N,N-dimethylammonium bromide (1) | 98.4% by weight |
| N-tetradecyl-N,N-dimethylamine | 0.23% by weight |
| N-tetradecyl-N,N-dimethylammonium bromide | 1.34% by weight |

2. Precursor for Examples 2 and 5

An apparatus as described in Example 1 is used. The following are added successively to the flask with stirring: 164.8 g (0.6 mol) of N-hexadecyl-N,N-dimethylamine, 268.8 g (6.55 mol) of acetonitrile and 104.0 g (0.63 mol) of 1-bromohexane. The mixture is heated to 85° C. with stirring in the course of 4 hours and is then cooled to room temperature, and the residual amine content is determined in a sample and an amine conversion of 99.1% is determined from this. Working-up by means of a rotary evaporator and subsequent treatment in an oil pump vacuum is carried out as described in Example 1. The N-hexadecyl-N-hexyl-N,N-dimethylammonium bromide (2) thus obtained is used for the viscosity measurements described below. The following contents are determined analytically:

| | |
|---|---|
| N-hexadecyl-N-hexyl-N,N-dimethylammonium bromide (2) | 98.0% by weight |
| N-hexadecyl-N,N-dimethylamine | 0.5% by weight |
| N-hexadecyl-N,N-dimethylammonium bromide | 1.5% by weight |

3. Precursor for comparison experiments A and C and also Examples 3 and 6

The procedure is as described in Example 1, but the following are added successively to the flask with stirring: 157.4 g (0.65 mol) of N-tetradecyl-N,N-dimethylamine, 240.0 g (5.85 mol) of acetonitrile and 82.6 g (0.683 mol) of allyl bromide. The contents of the flask warm up without external heating to 61° C. in the course of 20 minutes. The flask is then heated again to 70° C. by means of the external heating and kept at this temperature with stirring for 1 hour and then cooled to room temperature, and an amine conversion of 99.7% is determined in a sample of the contents of the flask by a residual amine determination. Working-up is carried out as described in Example 1. The N-tetradecyl-N-allyl-N,N-dimethylammonium bromide (3) thus obtained is used for the viscosity determinations described below. The following contents are determined analytically:

| | |
|---|---|
| N-tetradecyl-N-allyl-N,N-dimethylammonium bromide (3) | 98.4% by weight |
| N-tetradecyl-N,N-dimethylamine | 0.05% by weight |
| N-tetradecyl-N,N-dimethylammonium bromide | 1.5% by weight |

4. Precursor for comparison experiments B and D and also Examples 3 and 6

The procedure is as described in Example 1, but the following are added successively to the flask with stirring: 145.3 g (0.60 mol) of N-tetradecyl-N,N-dimethylamine, 267.0 g (6.5 mol) of acetonitrile and 121.7 g (0.63 mol) of 1-bromooctane. The mixture is heated to 80° C. with stirring and kept at this temperature for 4 hours and then cooled to room temperature, and an amine conversion of 98% is determined in a sample of the contents of the flask by a residual amine determination. Working-up is carried out as described in Example 1. The N-tetradecyl-N-octyl-N,N-dimethylammonium bromide (4) thus obtained is used for the viscosity determinations described below. The following contents are determined analytically:

| | |
|---|---|
| N-tetradecyl-N-octyl-N,N-dimethylammonium bromide (4) | 98.0% by weight |
| N-tetradecyl-N,N-dimethylamine | 0.5% by weight |
| N-tetradecyl-N,N-dimethylammonium bromide | 1.1% by weight |

For the viscosity determination, mixtures according to the invention (designated as "Example" with number) and mixtures not according to the invention (designated as "Comparison Experiment" with capital letter) with water in the amount ratios shown in Table 1 which follows are prepared with stirring at 80° C. from the ammonium compounds whose preparation was described in the preceding sections, cooled to measuring temperature and the viscosity (V) at the temperature indicated (T) and shear rate (D) in the mixtures which contain up to 70% by weight of ammonium compounds and a minimum of 30% by weight of water (W) are measured using the rotary viscometer Rheolab MC 10 from "Physica", W-7000 Stuttgart 80, Germany, using the measuring head Z 1 (DIN). The results obtained are shown in the following Table 1:

TABLE 1

| Example/ Comparison Experiment | Concentrate composition compound/amount [g] | | | W [% by weight] | Viscosity measurement T [°C.] | D [1/s] | V [mPa · s] |
|---|---|---|---|---|---|---|---|
| 1 a | (1)/4 | — | $H_2O$/16 | 80 | 35 | 100 | 27 |
| b | (1)/6 | — | $H_2O$/14 | 70 | 35 | 100 | 31 |
| c | (1)/10 | — | $H_2O$/10 | 50 | 35 | 100 | 36 |
| d | (1)/14 | — | $H_2O$/6 | 30 | 35 | 100 | 77 |
| 2 a | (2)/4 | — | $H_2O$/16 | 80 | 35 | 100 | 73 |
| b | (2)/6 | — | $H_2O$/14 | 70 | 35 | 100 | 48 |
| c | (2)/10 | — | $H_2O$/10 | 50 | 35 | 100 | 59 |
| d | (2)/13 | — | $H_2O$/7 | 35 | 35 | 100 | 95 |
| A a | (3)/4 | — | $H_2O$/16 | 80 | 35 | 100 | <10 |
| b | (3)/7 | — | $H_2O$/13 | 65 | 35 | 100 | 86 |
| c | (3)/10 | — | $H_2O$/10 | 50 | 35 | 100 | >5,000 |
| B a | (4)/4 | — | $H_2O$/16 | 80 | 35 | 100 | 534 |
| b | (4)/4 | — | $H_2O$/16 | 80 | 35 | 50 | >2,000 |
| c | (4)/8 | — | $H_2O$/12 | 60 | 35 | 100 | 35 |
| d | (4)/12 | — | $H_2O$/8 | 40 | 35 | 100 | 49 |
| 3 a | (3)/3 | (4)/3 | $H_2O$/14 | 70 | 35 | 100 | 94 |
| b | (3)/5 | (4)/5 | $H_2O$/10 | 50 | 35 | 100 | 100 |
| c | (3)/4 | (4)/4 | $H_2O$/12 | 60 | 35 | 100 | 168 |

The preparation of the compounds (1) to (4) is described above, as is the meaning of T, D, V and W (=% by weight of water in the concentrate).

In Example 3, a mixture of the two compounds (3) and (4) according to the invention with water is employed. The mixtures of the individual compounds (3) or (4) with water are not according to the invention and are consequently designated as Comparison Experiment.

Calculation of the average formula (I) for the mixture used in Example 3:

This mixture is composed of equal parts by weight of N-tetradecyl-N-allyl-N,N-dimethylammonium bromide (3) and N-tetradecyl-N-octyl-N,N-dimethylammonium bromide (4).

In Example 3 a,

| | | |
|---|---|---|
| 3 g = | 0.008278 | mol of compound (3) and |
| 3 g = | 0.006903 | mol of compound (4) |
| | 0.015181 | mol |

are employed, which are standardized to 1 mol for the mixture (3) +(4):

| | | |
|---|---|---|
| 0.5453 mol | (3) = x (IIA) | see description |
| 0.4547 mol | (4) = y (IIB) | top of page 6 |
| 1.0000 mol | | |

The first equation on page 6 of the description rewritten in terms of p reads:

$$p = \frac{x\,(IIA)\,[IIAR^1 + 2(IIBR^5) - IIBR^1 - 2(IIAR^5)] - 2(IIBR^5) - IIBR^1}{2}$$

The meanings of $IIAR^1$, $IIAR^5$, $IIBR^1$ and $IIBR^5$ are explained on page 6. In the present case, this gives:

$$1p = \frac{0.5453\,[14 + 2 \times 8 - 14 - 2 \times 3] - 2 \times 8 + 14}{2} = \frac{0.5453\,[10] - 1}{2} \approx 1.73$$

Since both ammonium compounds employed have a substituent $R^1$ having 14 carbon atoms, $R^1$ also has the average formula (I) n=14 carbon atoms, and according to the invention the substituent $R^2$ should then have n/2−p carbon atoms, where p is 1 or 2.

As calculated, p=1.73, i.e. is between 1 and 2, and the mixture is according to the invention. The substituent $R^2$ of the average formula has 14/2−1.73=5.27 carbon atoms. The formula reads

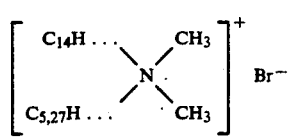

and is according to the invention.

From about 70% by weight and more of ammonium compounds and correspondingly 30% by weight and less of water, the viscosity measurement, in particular at elevated temperatures, is difficult as the mixtures tend to form a skin on the surface to a greater or lesser extent in open systems, as a result of which reproducible viscosity measurements cannot be obtained. For comparison here, the following process was used: cylindrical glass vessels, the diameter of the base of which is 5 cm and the height of which is 10 cm, are filled to ¼ of their content with the mixtures to be investigated, tightly sealed and brought to the investigation temperature for 1 hour. The vessels are then shaken and the viscous behavior of their contents is assessed visually. The experimental conditions and results are shown in Table 2 below:

TABLE 2

| Example/ Comparison Experiment | Concentrate composition compound/amount [g] | | | W [% by weight] | T [°C.] | Viscosity assessment |
|---|---|---|---|---|---|---|
| 4 a | (1)/37.5 | — | $H_2O$/12.5 | 25 | 30 | highly fluid |
| b | (1)/40 | — | $H_2O$/10 | 20 | 50 | highly fuid |
| 5 a | (2)/37.5 | — | $H_2O$/12.5 | 25 | 60 | highly fluid |
| b | (2)/40 | — | $H_2O$/10 | 20 | 65 | highly fluid |
| C | (3)/35 | — | $H_2O$/15 | 30 | 70 | mixture of highly fluid and solid, gelatinous constituents, non-homogenizable |
| D | (4)/35 | — | $H_2O$/15 | 30 | 70 | gelatinous, non-pourable |
| 6 a | (3)/17.5 | (4)/17.5 | $H_2O$/15 | 30 | 70 | highly fluid |
| b | (3)/20 | (4)/20 | $H_2O$/10 | 20 | 70 | viscous, but pourable |

We claim:

1. A water-containing concentrate of at least one alkyl- or alkenyl-substituted ammonium compound consisting essentially of a) 40 to 85% by weight of an ammonium compound of the formula

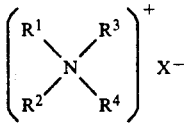

(I)

in which $R^1$ is a straight-chain alkyl radical or a straight-chain alkenyl radical having 12, 14, 16, or 18 carbon atoms, $R^2$ is a straight-chain alkyl radical or a straight-chain alkenyl radical (1) having 4, 5, or 6 carbon atoms wherein $R^1$ has 12 carbon atoms, (2) having 5 or 6 carbon atoms when $R^1$ has 14 carbon atoms, (3) having 6 or 7 carbon atoms when $R^1$ has 16 carbon atoms, or (4) having 7 or 8 carbon atoms when $R^1$ has 18 carbon atoms, $R^3$ and $R^4$, which are identical or different, are a hydrogen atom or a methyl radical, and X is a chloride, bromide, methylsulfate, phenylsulfonate, or methylphenylsulfonate anion, or of a mixture of such ammonium compounds, and (b) 15 to 60% by weight of water, percentages by weight being relative to the total mixture.

2. A water-containing concentrate of at least one alkyl- or alkenyl-substituted compound which contains a mixture of at least two ammonium compounds consisting essentially of a) 40 to 85% by weight of a mixture consisting of a first ammonium compound of the formula

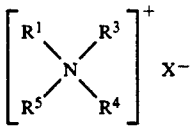

(II)

in which $R^1$ is a straight-chain alkyl radical or straight-chain alkenyl radical having 12, 14, 16, or 18 carbon atoms, $R^5$ is a straight-chain alkyl radical or a straight-chain alkenyl radical (1) having 3 carbon atoms when $R^1$ has 12 carbon atoms, (2) having 3 or 4 carbon atoms when $R^1$ has 14 carbon atoms, (3) having 4 carbon atoms when $R^1$ has 16 carbon atoms, or (4) having 5 or 6 carbon atoms when $R^1$ had 18 carbon atoms, $R^3$ and $R^4$, which are identical or different, are a hydrogen atom or a methyl radical, and X is a chloride, bromide, methylsulfate, phenylsulfonate, or methylphenylsulfonate anion, and of a second ammonium compound of the formula

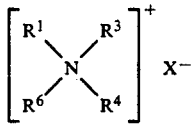

(III)

$R^1$ is a straight-chain alkyl radical or a straight-chain alkenyl radical having 12, 14, 16, or 18 carbon atoms, $R^6$ is straight-chain alkyl radical or a straight-chain alkenyl radical (1) having 7 or 8 carbon atoms when $R^1$ has 12 carbon atoms, (2) having 8, 9 or 10 carbon atoms when $R^1$ has 14 carbon atoms, or (3) having 9, 10, or 11 carbon atoms when $R^1$ has 16 carbon atoms or 18 carbon atoms, $R^3$ and $R^4$, which are identical or different, are a hydrogen atom or a methyl radical, and X is a chloride, bromide, methylsulfate, phenylsulfonate, or methylphenylsulfonate anion, the two ammonium compounds (II) and (III) having been mixed in such a ratio that the average of the numbers of the carbon atoms of $R^5$ and $R^6$ in the mixture has a value of $n/2-p$, wherein n is the number of the carbon atoms of $R^1$ and p is 1 to 2, and wherein $R^1$ formulae (II) and (III) can be the same or different from each other and b) 15 to 60% by weight of water, the percentages by weight being relative to the total mixture.

3. A water-containing concentrate comprising a mixture of a) at least one alkyl- or alkenyl-substituted ammonium compound of the formula

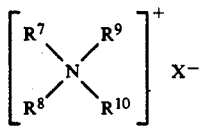

(IV)

in which $R^7$ is a long straight-chain alkyl radical or a long straight-chain alkenyl radical having 12 to 18 carbon atoms, $R^8$ is a medium straight-chain alkyl radical or medium straight-chain alkenyl radical having from 3 to 11 carbon atoms, $R^9$ and $R^{10}$ which are identical or different are a hydrogen atom or methyl radical and X is a chloride, bromide, methylsulfate, phenylsulfate, or methylphenylsulfonate anion and, b) water.

4. The water-containing concentrate as claimed in claim 3, wherein $R^8$ is a medium chain alkyl radical having from 5 to 8 carbons.

5. The water-containing concentrate as claimed in claim 3, wherein $R^8$ is a medium chain alkyl radical having from 7 to 11 carbons.

6. The water-containing concentrate as claimed in claim 3, wherein $R^8$ is a medium chain alkyl radical having from 3 to 6 carbons.

7. The water-containing concentrate as claimed in claim 3, wherein water is in an amount from 15 to 60% by weight.

8. The water-containing concentrate as claimed in claim 4, wherein water is in an amount from 15 to 60% by weight.

9. The water-containing concentrate as claimed in claim 3, wherein the ammonium compound or mixture of ammonium compounds is in an amount from 40 to 85% by weight.

10. The water-containing concentrate as claimed in claim 8, wherein the ammonium compound or mixture of ammonium compounds is in an amount from 40 to 85% by weight.

11. A compound comprising an alkyl- or alkenyl-substituted ammonium compound of the formula (IV)

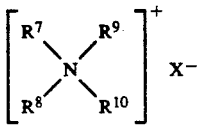

(IV)

in which $R^7$ is a long straight-chain alkyl radical or a long straight-chain alkenyl radical having 12 to 18 carbon atoms, $R^8$ is a medium straight-chain alkyl radical or medium straight-chain alkenyl radical having from 3 to 11 carbon atoms, $R^9$ and $R^{10}$ which are identical or different are a hydrogen atom or methyl radical and X is a chloride, bromide, methylsulfate, phenylsulfate, or methyl phenylsulfate anion.

* * * * *